US012535019B2

(12) United States Patent
Scheidig

(10) Patent No.: US 12,535,019 B2
(45) Date of Patent: Jan. 27, 2026

(54) CAMSHAFT ADJUSTMENT SYSTEM FOR FLEXIBLY STARTING AN INTERNAL COMBUSTION ENGINE, AND METHOD FOR OPERATING A DRIVETRAIN

(71) Applicant: Schaeffler Technologies AG & Co. KG, Herzogenaurach (DE)

(72) Inventor: Gerhard Scheidig, Fürth (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 18/570,973

(22) PCT Filed: Jun. 7, 2022

(86) PCT No.: PCT/DE2022/100422

§ 371 (c)(1),
(2) Date: Dec. 15, 2023

(87) PCT Pub. No.: WO2022/262902

PCT Pub. Date: Dec. 22, 2022

(65) Prior Publication Data

US 2024/0287921 A1 Aug. 29, 2024

(30) Foreign Application Priority Data

Jun. 16, 2021 (DE) ..... 10 2021 115 590.8

(51) Int. Cl.
*F01L 1/344* (2006.01)

(52) U.S. Cl.
CPC ... *F01L 1/3442* (2013.01); *F01L 2001/34426* (2013.01); *F01L 2001/34466* (2013.01);
(Continued)

(58) Field of Classification Search
CPC ..... F01L 1/3442; F01L 2001/34466; F01L 2001/34459; F01L 2001/3443
See application file for complete search history.

(56) References Cited

U.S. PATENT DOCUMENTS

2015/0090207 A1* 4/2015 Lichti ..... F01L 1/3442 123/90.1
2015/0218975 A1* 8/2015 Shum ..... F01L 1/344 123/90.17
2015/0260060 A1* 9/2015 Fischer ..... F01L 1/3442 123/90.15

FOREIGN PATENT DOCUMENTS

DE 102013220241 A1 4/2014
DE 102015120851 A1 * 1/2017 ..... F01L 1/047
(Continued)

*Primary Examiner* — Ngoc T Nguyen

(57) ABSTRACT

The disclosure relates to a camshaft adjustment system comprising a hydraulic camshaft adjuster having a stator and a rotor forming at least one working chamber. The at least one working chamber is divided into a first sub-chamber and a second sub-chamber The sub-chambers interact with a control valve controllable via a first actuator. When the first sub-chamber undergoes a volume increase, the rotor is displaced into a late position relative to the stator, and when the second sub-chamber undergoes a volume increase, the rotor is displaced into an early position relative to the stator. A second actuator actuated independently of the first actuator is provided. In order to release the camshaft adjuster from the late position when in an operating state, a ram of the second actuator displaces a locking pin of a late-locking device of the camshaft adjuster out of its position that locks the late position.

11 Claims, 10 Drawing Sheets

(52) U.S. Cl.
CPC . *F01L 2001/34483* (2013.01); *F01L 2800/01* (2013.01); *F01L 2800/02* (2013.01)

(56) References Cited

FOREIGN PATENT DOCUMENTS

| | | | | |
|---|---|---|---|---|
| DE | 102017113648 | A1 | 12/2018 | |
| DE | 102019119939 | A1 | 9/2020 | |
| DE | 102020125949 | A1 | 4/2022 | |
| EP | 2899377 | B1 * | 5/2016 | ..... F01L 1/344 |

* cited by examiner

CAMSHAFT ADJUSTMENT SYSTEM FOR FLEXIBLY STARTING AN INTERNAL COMBUSTION ENGINE, AND METHOD FOR OPERATING A DRIVETRAIN

CROSS-REFERENCE TO RELATED APPLICATIONS

This application is the U.S. National Phase of PCT Application No. PCT/DE2022/100422 filed on Jun. 7, 2022, which claims priority to DE 10 2021 115 590.8 filed on Jun. 16, 2021, the entire disclosures of which are incorporated by reference herein.

TECHNICAL FIELD

The disclosure relates to a camshaft adjustment system.

BACKGROUND

In principle, it may be required to set a rotational angle position of the camshaft relative to a crankshaft differently depending on an existing temperature of the internal combustion engine (cold or warm start) before the internal combustion engine is started in order to use the resulting effects on the decompression and compression of the combustion chambers.

In addition, there is a need to further simplify a structure of adjustment mechanisms used for individual, oil pressure-independent adjustment of a camshaft adjuster and to make them as reproducible as possible using common means.

SUMMARY

It is therefore the object of the present disclosure to provide a camshaft adjustment system which has a simple structure and at the same time enables variable adjustment of the compression of an internal combustion engine for start-up.

This is achieved according to the disclosure in that a second actuator actuated independently of the first actuator is provided, and this second actuator is arranged and formed such that, in order to release the camshaft adjuster from the late position (which can also be referred to as "the retarded position") when in an operating state, a ram of the second actuator displaces a locking pin of a late-locking device (which can also be referred to as a "retard-locking device") of the camshaft adjuster out of its position that locks the late position.

By providing this second actuator and coupling it to the late-locking device, the structure used for oil pressure-independent actuation/adjustment of the camshaft adjuster is significantly simplified. Furthermore, the second actuator can be arranged independently of the first actuator in order to save space.

Further example embodiments are explained in greater detail below.

Accordingly, the camshaft adjuster can be designed such that when the hydraulic pressure falls below a minimum hydraulic pressure (within the sub-chambers), the camshaft adjuster is automatically rotated into a predetermined (preferably form-fittingly supported) starting position relative to the second actuator, in which the ram is coupled in an axially displaceable manner to the locking pin. This ensures the functionality of the system in a simple manner.

If the late-locking device is designed such that, when the minimum hydraulic pressure of the camshaft adjuster falls below the minimum hydraulic pressure, the rotor is displaced into the late position and the locking pin of the late-locking device automatically locks the rotor in a rotationally fixed manner relative to the stator, the late position is reliably set when the internal combustion engine is switched off. This enables reliable camshaft adjustment.

The ram of the second actuator can be indirectly axially coupled to the locking pin of the late-locking device via a sliding element which is axially displaceably accommodated in the stator. This allows the second actuator to be arranged in as space-saving a manner as possible.

In addition, the ram and/or the sliding element can be preloaded by a (respective individual) return spring into a rest position arranged in a powerless manner relative to the locking pin (the late-locking device). This means that the camshaft adjuster can be precisely controlled in its various positions.

The second actuator is arranged relative to the camshaft adjuster in as space-saving a manner as possible if the ram is coupled to the sliding element via a plate (forming a lever).

If the plate is also fork-shaped and has two arms extending/protruding from opposite circumferential sides, which are arranged on a common (radial) diameter with the sliding element, said coupling between the ram and locking pin is reliably implemented even with different rotational positions of the camshaft adjuster relative to the second actuator.

In particular, the sliding element is reliably contacted by the plate during operation if the arms of the plate are implemented in a ramp shape on their side facing the sliding element such that they rise with this side towards their free end in the circumferential direction/extend axially away from the locking pin. The arms of the plate are therefore preferably curved. This also results in a space-saving and lightweight design of the plate.

Furthermore, the camshaft adjuster can be provided with a central locking device for locking the driven part relative to the stator in at least one center position offset from the late position towards the early position (which can also be referred to as "the advanced position". This results in as skillful a design as possible of the camshaft adjuster for starting the internal combustion engine during a cold start.

With regard to the central locking device, it is also useful if it is designed as a multi-stage, or, in an example embodiment, a three-stage ratchet.

Furthermore, the second actuator can be an electric magnetic actuator. As a result, the structure of the second actuator is further simplified and in particular can only be switched between two states (ON and OFF), which is sufficient to ensure the reliable locking function of the second actuator.

The disclosure also relates to a method for operating a drive train having a camshaft adjustment system according to the disclosure according to any one of the aforementioned embodiments, such as a hybrid drive train of a motor vehicle. The stator is rotatably coupled to a crankshaft of an internal combustion engine by means of a timing drive, the rotor is connected to a camshaft (preferably implemented as an inlet camshaft) of the internal combustion engine, and an electric machine is operatively connected to the crankshaft. The method comprises the following steps: a) unlocking the late-locking device supporting the rotor in the late position relative to the stator by activating the second actuator, and b) rotating the crankshaft via the electric machine such that the stator and the rotor of the camshaft adjuster are rotated relative to one another towards the early position until a central locking device automatically locks the camshaft adjuster in a center position.

In an example embodiment, the electric machine rotates/reverses the crankshaft in step b) against a main direction of rotation implemented during operation of the internal combustion engine. This allows the crankshaft to be turned as gently as possible.

BRIEF DESCRIPTION OF THE DRAWINGS

The disclosure is now be explained in more detail with reference to drawings, in which context various exemplary embodiments are also shown.

In the figures.

DETAILED DESCRIPTION

The figures are merely schematic in nature and serve solely for understanding the disclosure. Identical elements are provided with the same reference symbols.

Figure 2:
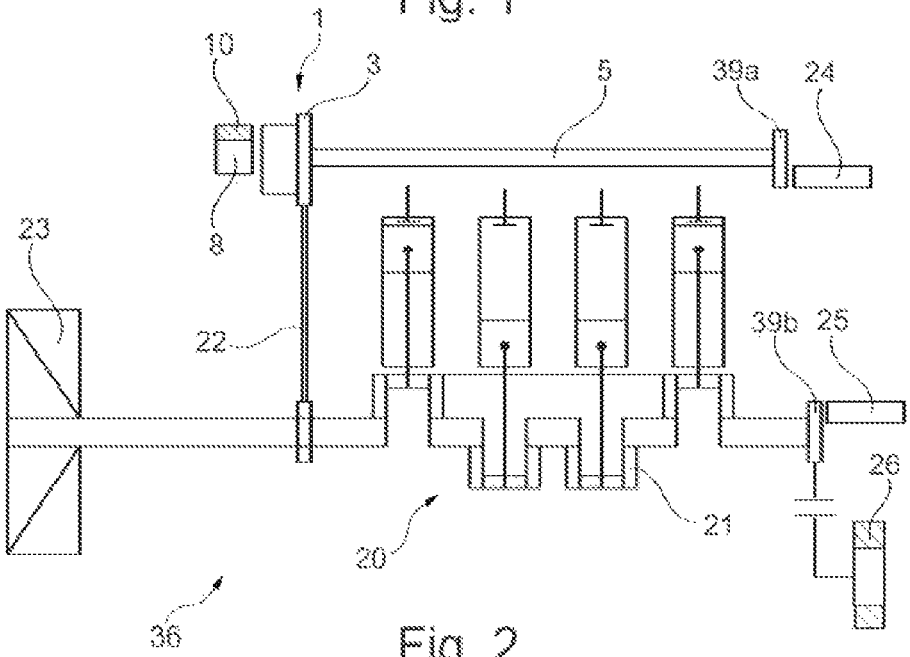
FIG. 2 shows a schematic longitudinal sectional representation of part of a drive train having an internal combustion engine and a camshaft adjustment system according to FIG. 1.

FIG. 2 illustrates a preferred area of application of a hybrid module 1 according to the disclosure. The camshaft adjustment system 1 is arranged on a camshaft 5 of an internal combustion engine 20, which internal combustion engine 20 is part of a hybrid drive train 36. A crankshaft 21 of the internal combustion engine 20 is permanently rotatably connected in the usual manner to the camshaft adjustment system 1 via a timing drive 22, namely a stator 4 of a camshaft adjuster 3 of the camshaft adjustment system 1. A rotor 6 of the camshaft adjuster 3 is attached to one end of a camshaft 5. The camshaft 5 is implemented as an inlet camshaft in this embodiment.

An electric machine 23 is also attached/rotatably connected to the crankshaft 21 via its rotor, which is not shown in further detail for the sake of clarity. The electric machine 23 is designed such that it serves as a generator in the hybrid drive train of the motor vehicle, but is used in at least one further operating state as a drive machine, for example as a starter of the internal combustion engine 20.

Furthermore, a camshaft sensor 24 is provided on the internal combustion engine 20, which detects the speed and rotation angle position of the camshaft 5 via a first trigger wheel 39*a*, and a crankshaft sensor 25, which detects the speed and angle of rotation position of the crankshaft 21 via a further second trigger wheel 39*b*. The crankshaft 21 is used in the usual manner to drive a wheel 26 of the motor vehicle, shown in simplified form.

Figure 1:
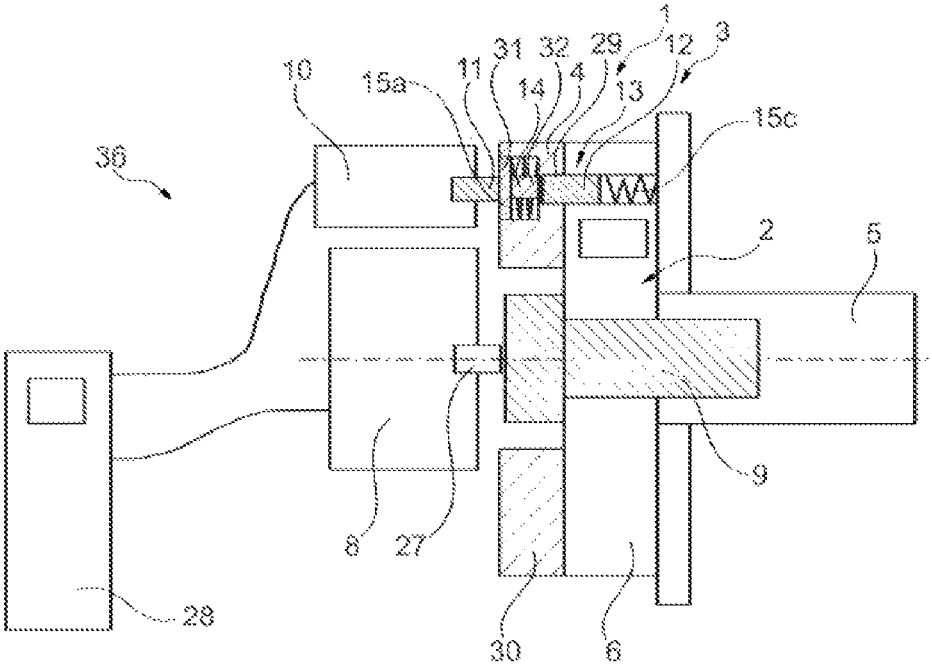
FIG. 1 shows a schematic longitudinal sectional representation of a camshaft adjustment system according to the disclosure according to a first exemplary embodiment, wherein a coupling of an actuator with a locking pin of a late-locking device of a camshaft adjuster can be seen in more detail.

The camshaft adjustment system 1 according to the disclosure can be seen in a simplified representation in FIG. 1. The camshaft adjustment system 1 shown in a first exemplary embodiment has the camshaft adjuster 3, which is implemented as a hydraulic camshaft adjuster 3, namely as a camshaft adjuster 3 of the vane cell type. Accordingly, the stator 4 and rotor 6 can be rotated relative to one another in a limited rotation angle range with the interposition of several working chambers 2 distributed in the circumferential direction. For a basic structure of such a camshaft adjuster 3, DE 10 2017 113 648 A1 is considered to be integrated herein.

To control/adjust the camshaft adjuster 3, a control valve 9 is used as a central valve. The control valve 9, which is hydraulically coupled on the input side with a pump (not shown for the sake of clarity), can be moved into various positions in the usual manner in order to, among other things, create a first sub-chamber 7*a* or a second sub-chamber 7*b* of each working chamber 2, which, as shown in more detail in connection with the second exemplary embodiment, are intended to apply hydraulic pressure and thereby rotate the stator 4 and the rotor 6 relative to one another, or to block them relative to one another and to set the different switching states/operating states of the camshaft adjustment system 1.

It can also be seen that the control valve 9 is controlled/adjusted via a first actuator 8, which is designed as a central actuator. The first actuator 8 has an armature 27 or an armature ram, which is arranged coaxially to an axis of rotation of the camshaft 5. The control valve 9 is arranged radially inside the rotor 6. The first actuator 8 is arranged axially offset from the control valve 9 and fixed to the housing/accommodated on a housing of the internal combustion engine 20.

Furthermore, according to the disclosure, a second actuator 10 is present, which can be actuated independently of the first actuator 8. The second actuator 10 is used to adjust, in particular to unlock, a locking pin 12 of a late-locking device 13. The second actuator 10 is arranged radially offset from the first actuator 8. Furthermore, the second actuator 10 is arranged axially next to the camshaft adjuster 3. The second actuator 10 is also fixed to the housing/accommodated on a housing of the internal combustion engine 20.

Both actuators 8, 10 are connected to a control device 28, indicated in FIG. 1, and can be actuated via the same.

In the exemplary embodiment of FIG. 1, a ram 11 of the second actuator 10 is arranged radially at the level of the locking pin 12 of the late-locking device 13. The locking pin 12 is displaceably arranged in the rotor 6 and is engaged in a receiving hole 29 in a cover 30 of the stator 4 in the late position of the camshaft adjuster 3 implemented in FIG. 1. If the locking pin 12 is axially arranged in alignment with the receiving hole 29, as implemented in FIG. 1, it engages in the receiving hole 29 by means of a corresponding preload by means of a (third) return spring 15*c*, thus supporting the stator 4 relative to the rotor 6 in a rotationally fixed manner.

A movement coupling of the ram 11 with the locking pin 12 in the locked late position of the camshaft adjuster 3 shown in FIG. 1 takes place in this embodiment by means of a separate sliding element 14, which is slidably accommodated in the stator 4, more precisely in the cover 30. It can also be seen in FIG. 1 that this sliding element 14 forms a plate region 31 which is in axial contact with the ram 11. The sliding element 14 also forms a pin extension 32 adjacent to the plate area 31 in the direction of the locking pin 12 and is also arranged coaxially relative to the receiving hole 29.

It can also be seen that the sliding element 14 is preloaded towards the ram 11 via a first return spring 15*a*. As can be seen in more detail in connection with the second exemplary embodiment, inside the second actuator 10, the ram 11 is preloaded away from the locking pin 12 via a further second return spring 15*b*. As already mentioned, the locking pin 12 is preloaded towards the cover 30 via the third return spring 15*c* and into the receiving hole 29 in the locked late position.

It should also be noted that the second actuator 10 is implemented as an electric magnetic actuator. Consequently, the second actuator 10 can only be switched between a switched-on state and a switched-off state, wherein the ram 11 pushes the locking pin 12 out of the receiving hole 29 via the sliding element 14 in order to unlock the camshaft adjuster 3 from the late position in the switched-on state until the camshaft adjuster 3 is completely unlocked (from its late position). In the switched-off state, however, there is no magnetic displacement force acting on the ram 11 and consequently no displacement force on the sliding element 14 and the locking pin 12.

In conjunction with FIGS. 3 to 15, a more detailed structure of the camshaft adjuster 3 as well as the second actuator 10 and the control valve 9 can be seen, with reference to a second exemplary embodiment of the camshaft adjustment system 1 according to the disclosure. The structure and function of the camshaft adjustment system 1 of this second exemplary embodiment should correspond to those of the first exemplary embodiment.

Figure 3:
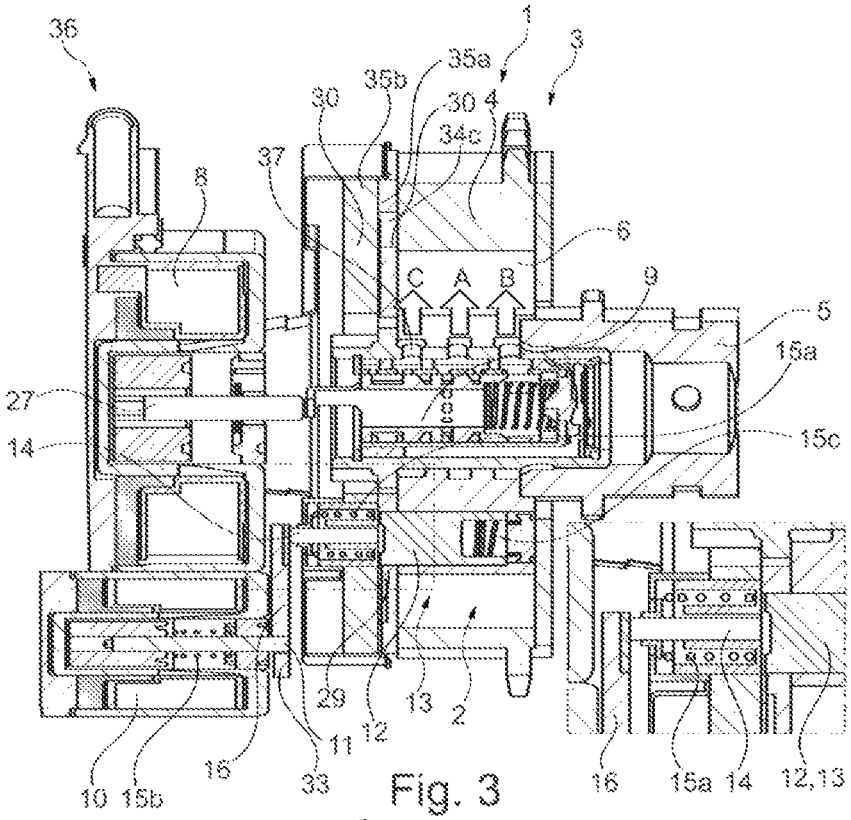
FIG. 3 shows a longitudinal sectional view of a camshaft adjustment system according to the disclosure according to a second exemplary embodiment, wherein the actuator actuating the late-locking device is coupled to the locking pin via a plate and a sliding element, and in an additional detailed view shown in the bottom right of the image plane, the coupling of the plate with the sliding element can be seen more in more detail.
Figure 4:
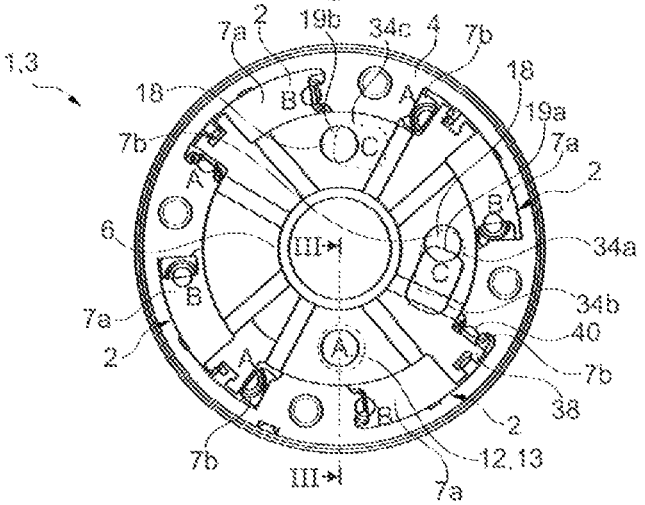
FIG. 4 shows a cross-sectional view of the camshaft adjuster used in the camshaft adjustment system according to FIG. 3, wherein a section line characterizing the longitudinal section according to FIG. 3 is designated "III-III,"
Figure 5:
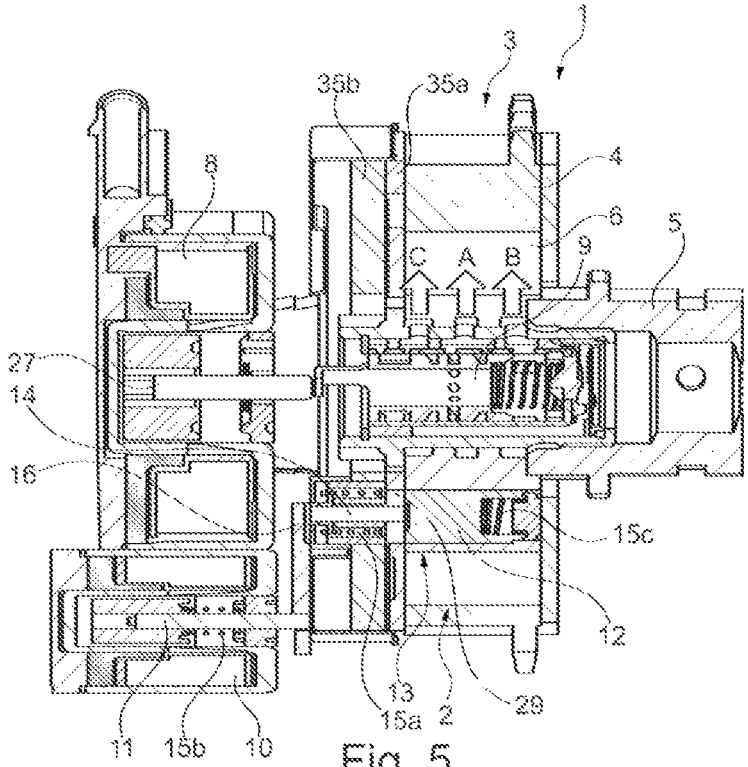
FIG. 5 shows a longitudinal sectional view of the camshaft adjustment system, similar to FIG. 3, wherein the actuator which interacts with the late-locking device is now activated and releases the locking pin via the plate and the sliding element, so that a rotor and a stator of the camshaft adjuster can be rotated relative to one another.

In FIG. 3, for example, it can be seen that a main difference from the first exemplary embodiment is that the second actuator 10 or the ram 11 is arranged radially offset from the locking pin 12 of the late-locking device 13 and a plate 16 serving as a lever is present for the movement coupling of the ram 11 with the sliding element 14. The plate 16 therefore serves to bridge the radial distance between the ram 11 and the sliding element 14.

Figure 6:
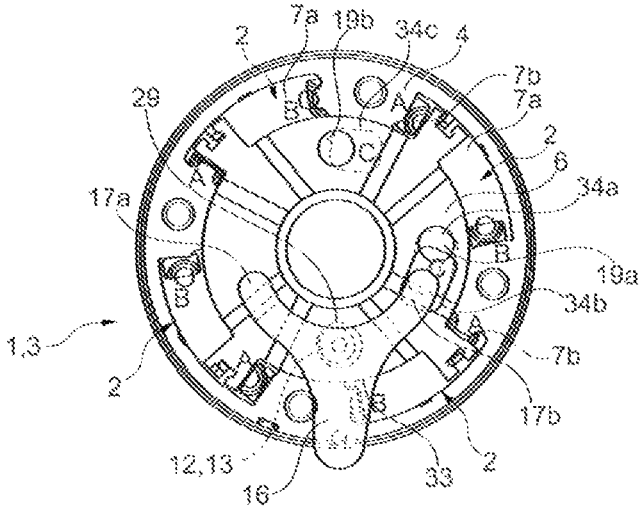
FIG. 6 shows a cross-sectional view of the camshaft adjuster connected according to FIG. 5, wherein the plate arranged between a ram and the sliding element can be seen in more detail in its extension.
Figure 7:
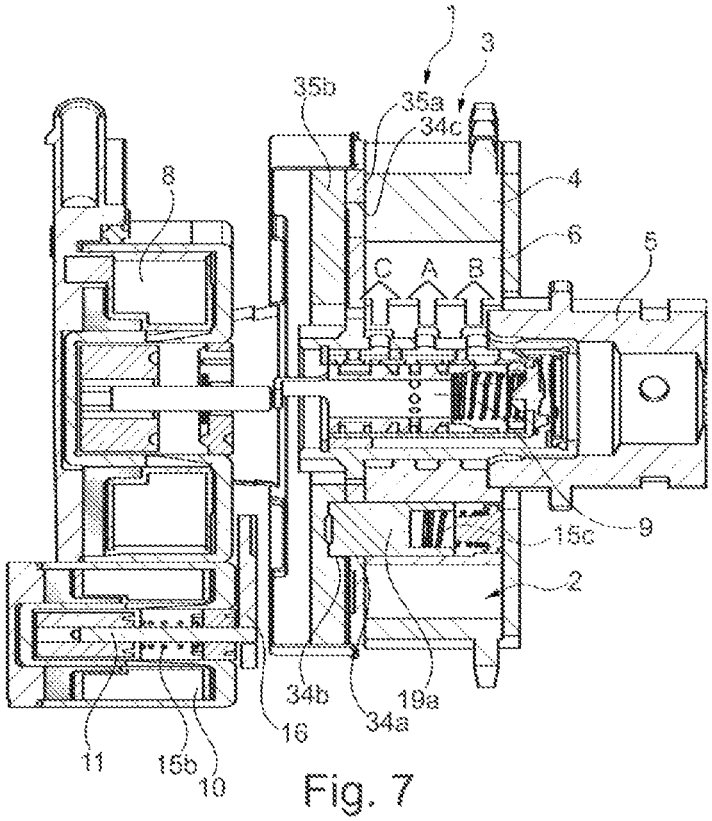
FIG. 7 shows a longitudinal sectional view of the camshaft adjustment system, similar to FIG. 3, wherein the sectional plane is now selected such that a further locking pin of a central locking device can be seen, which is already locked in the switching position shown.
Figure 8:
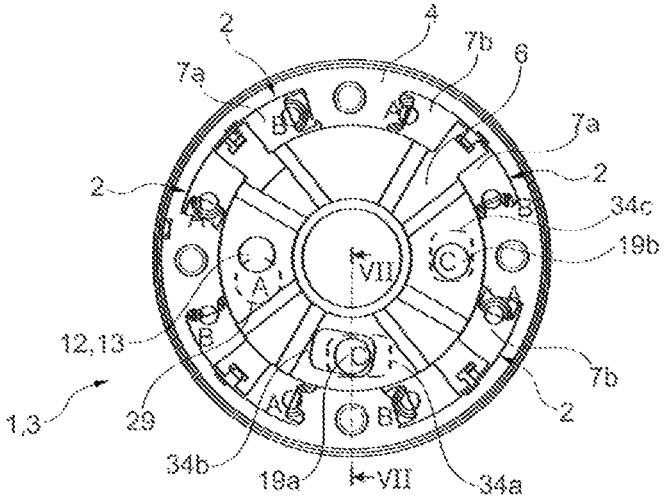
FIG. 8 shows a cross-sectional view of the camshaft adjuster connected according to FIG. 7, wherein the sectional plane characterizing the longitudinal section according to FIG. 7 is designated "VII-VII,"
Figure 9:
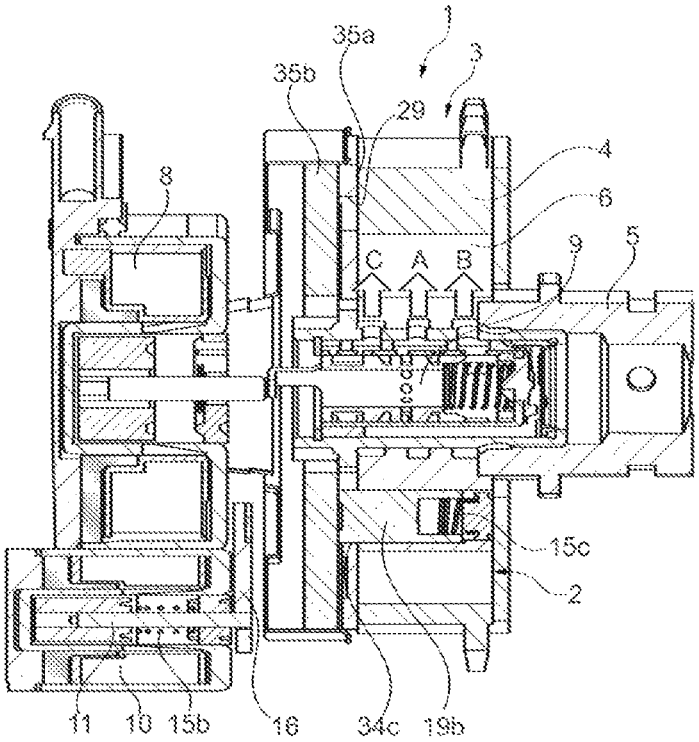
FIG. 9 shows a longitudinal sectional view of the camshaft adjustment system, similar to FIG. 3, wherein the sectional plane is selected such that a further locking pin of the central locking device can be seen in section.
Figure 10:
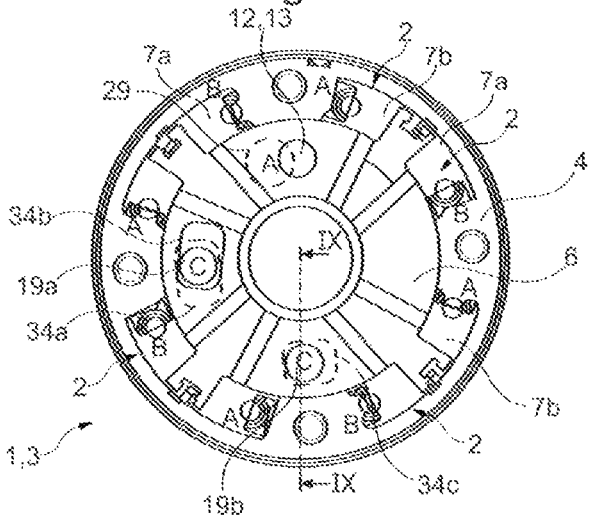
FIG. 10 shows a cross-sectional view of the camshaft adjuster used in FIG. 9, the sectional plane characterizing the longitudinal section according to FIG. 9 is designated "IX-IX,"
Figure 11A:
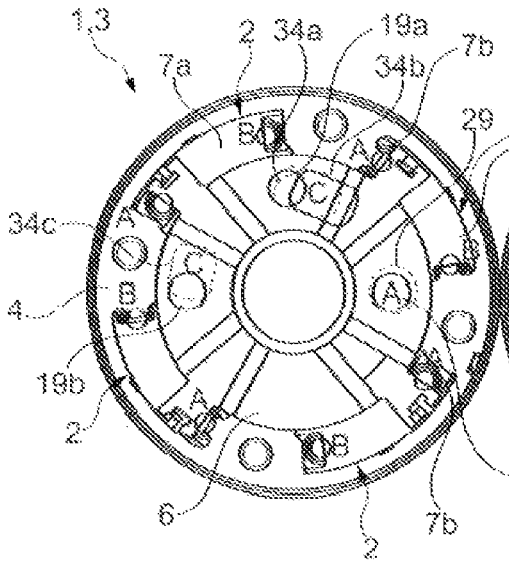
FIGS. 11*a* to 11*d* show several cross-sectional views of the camshaft adjuster implemented in FIG. 3 to illustrate different locking states.
Figure 11B:
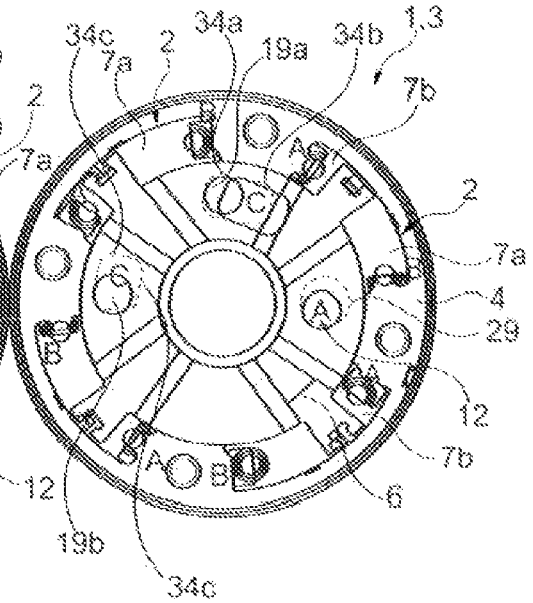
Figure 11C:
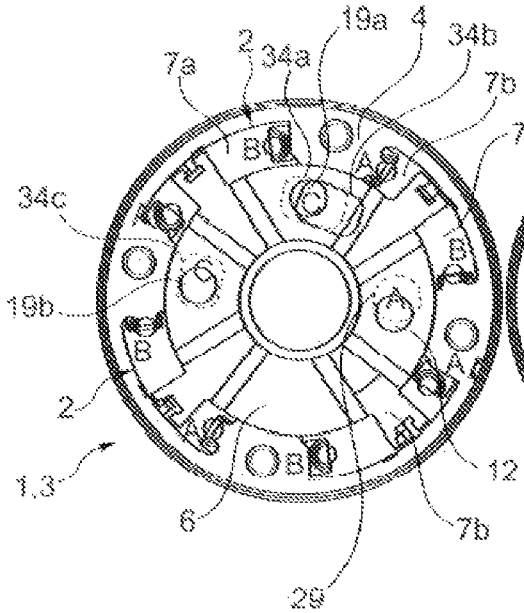
Figure 11D:
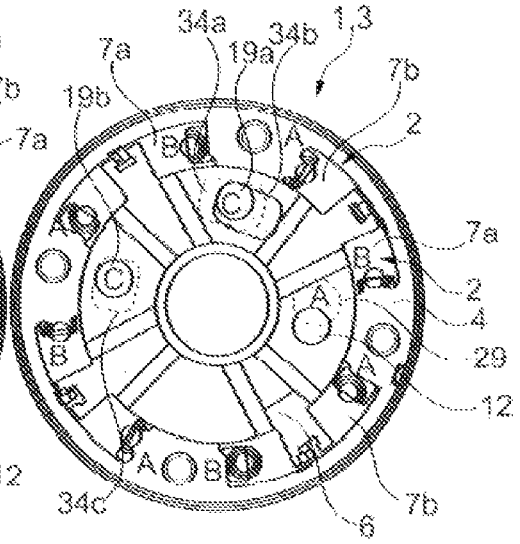
Figure 12A:
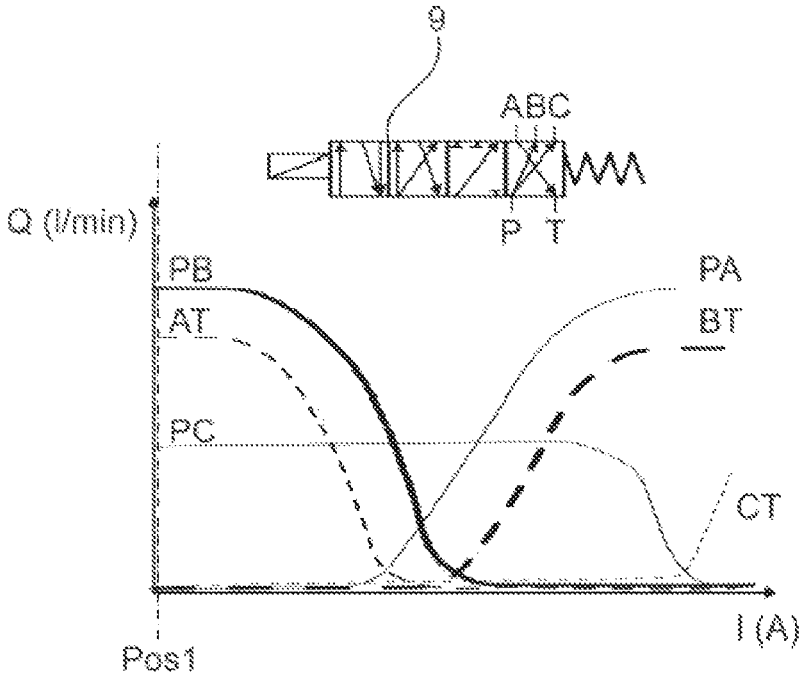
FIGS. 12*a* to 12*d* show several circuit diagrams to illustrate four different switching states of the camshaft adjuster used in FIG. 3, which can be selected by a central control valve.
Figure 12B:
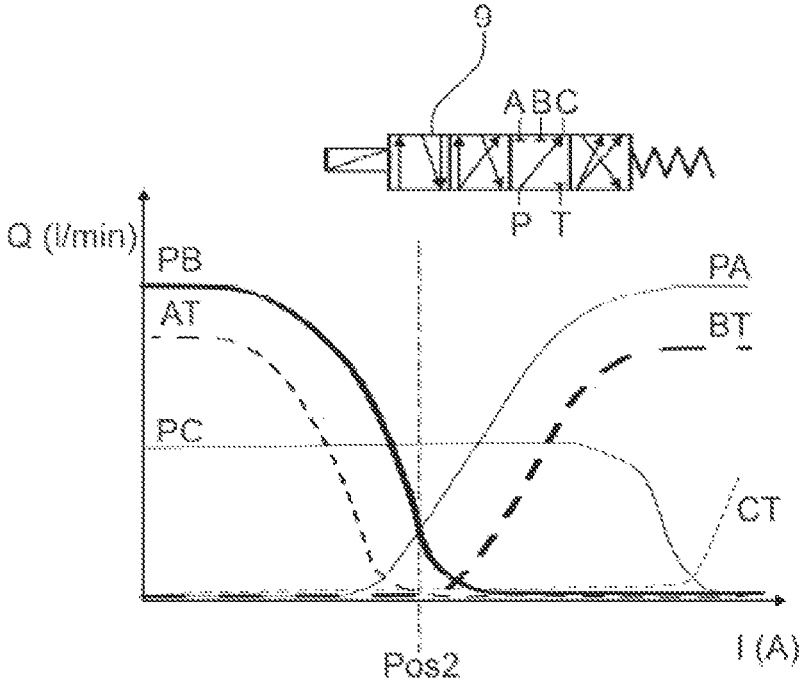
Figure 12C:
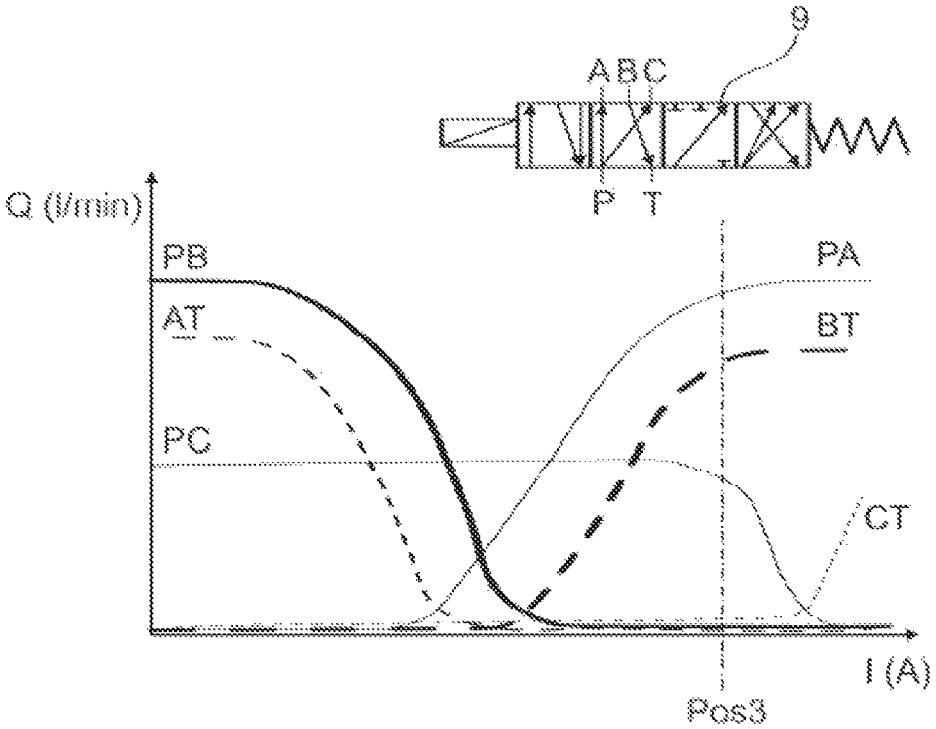
Figure 12D:
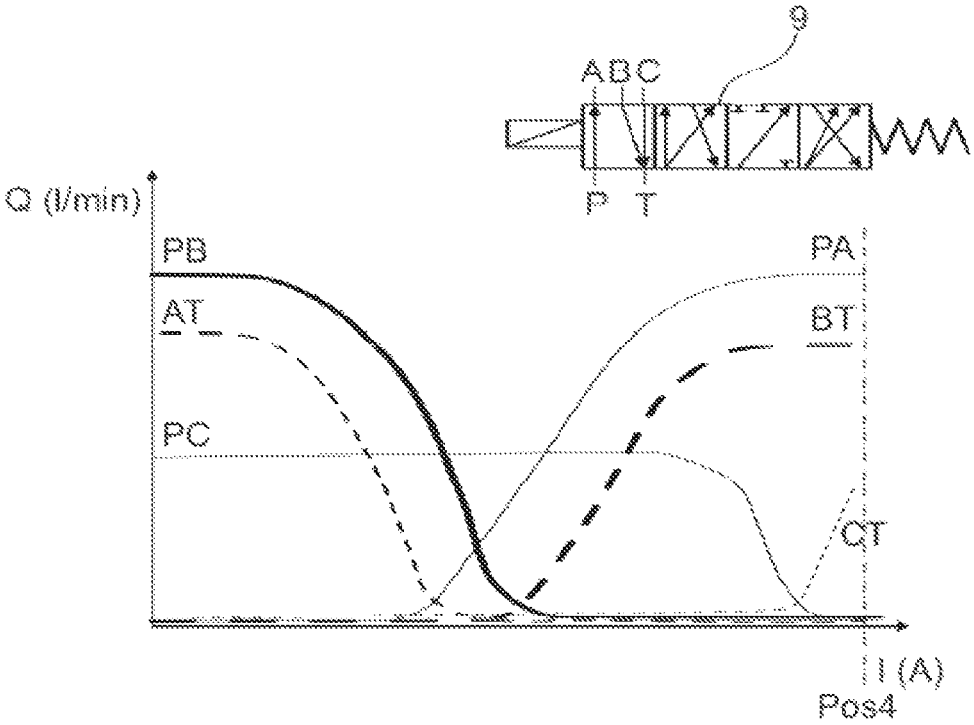

In this regard, a more detailed design of the plate 16 can be seen in connection with FIG. 6. The plate 16 is fork-shaped. The plate 16 has a web region 33 which rests axially on the ram 11 and extends inwards in the radial direction from the ram 11 towards the sliding element 14. The plate 16 is shown in FIG. 6 with its web area 33 directly in frontal contact with the sliding element 14. Furthermore, the plate 16 has a fork-shaped extension at the radial height of the sliding element 14/the receiving hole 29. This fork-shaped extension is formed by two arms 17*a*, 17*b* projecting in an opposite manner to one another in the circumferential direction from the web area 33. A first arm 17*a* thus extends from the web region 33 in a first circumferential direction, and a second arm 17*b* extends away in a second circumferential direction.

The arms 17*a*, 17*b* are bent towards their free ends such that they each form a ramp with their end faces facing axially towards the sliding element 14. The ramp is implemented such that the end face facing the sliding element 14 extends towards the free end of the respective arm 17*a*, 17*b* axially from the web area 33 to an axial side facing away from the camshaft adjuster 3. This enables the sliding element 14 to be cleverly captured when the camshaft adjuster 3 is rotated relative to the second actuator 10.

In FIGS. 7 to 10, it can also be seen that the camshaft adjuster 3 additionally has a central locking device 18. The central locking device 18 is used to lock/engage the camshaft adjuster 3, i.e., the stator 4 relative to the rotor 6, in at least one center position, or as shown here, several center positions. The central locking device 18 forms a multi-stage, namely three-stage, ratchet. Two different central locking pins 19*a*, 19*b* of the central locking device 18 are in operative connection with several holes 34*a* to 34*c* of two cover segments 35*a*, 35*b* of the stator 4 in order to implement the ratchet.

In other words, according to the disclosure, a camshaft adjuster 3 is equipped with a locking pin 12 in the late position, which locking pin 12 is supplied with oil pressure from a second sub-chamber 7*b* (also referred to as the A-chamber) and can thus unlock, but which can also can be unlocked mechanically by an additional unlocking mechanism comprising the ram 11 and the sliding element 14 and preferably also the plate 16.

The camshaft adjuster 3 has two additional central locking pins 19*a*, 19*b*, which in the locked state enable locking in the center/a center position. These central locking pins 19*a*, 19*b* can be unlocked hydraulically via a so-called C-channel 37. A mechanical ratchet is also integrated into the camshaft adjuster 3 by means of these two central locking pins 19*a*, 19*b*, which can prevent the camshaft adjuster 3 from moving back in three stages from the late position to the center position.

The camshaft adjuster 3 has two locking covers (referred to here as the first and second cover segments 35*a*, 35*b*) and can be designed both with and without a smart phasing function.

The control valve 9 is also a 5/4-way proportional central valve, comprising a pump connection (P), a connection to the first sub-chambers 7*a* (B), a connection to the second sub-chambers 7*b* (A), a C-channel 37 (C), and a tank connection (T) respectively and is designed to implement four positions or switching positions.

To control the control valve 9, a proportional central magnet in the form of the first actuator 8 is electrically controlled.

The further second actuator 10 is implemented as an electric magnetic actuator with an on/off function. This second actuator 10 has the task of pressing the unlocking mechanism formed by the sliding element 14 and the locking pin 12 of the late-locking device 13 in the camshaft adjuster 3 upon activation, preferably via a lever mechanism formed by the plate 16, and thus locking between the rotor 6 and stator 4 without releasing oil pressure.

Both actuators 8, 10 are controlled via the control device 28 or an electronic engine control device of the internal combustion engine 20.

In conjunction with the previously described drive train 36, a method according to the disclosure for operating the camshaft adjustment system 1 is implemented according to the following scheme:

When the engine is stopped/switched off, the internal combustion engine 20 is rotated with the aid of the electric machine 23 until a constantly identical standstill position (e.g., a top dead center (TDC) of a first cylinder/cylinder 1 of the internal combustion engine 20) is reached. A defined positive connection between the camshaft adjuster 3 and the camshaft 5 (timing pin) ensures that the sliding element 14 in the camshaft adjuster 3 is always in the same position (starting position; e.g., 6 o'clock) when at a standstill and thus the second actuator 10 is in this position via the ram 11, preferably the lever mechanism, and the sliding element 14 can unlock the locking pin 12 of the late-locking device 13. The standstill position of the internal combustion engine 20 is selected so that the camshaft 5 remains stationary such that a cam of the camshaft 5 exerts a torque in the late direction on the rotor 6 so that a wing 38 rests on the late stop 40 (FIG. 4) and the locking pin 12 of the late-locking device 13 can be released without lateral force. The camshaft adjuster 3 is therefore, on the one hand, designed such that when the hydraulic pressure falls below a minimum hydraulic pressure, it is automatically rotated into a predetermined starting position in which the ram 11 is coupled to the locking pin 12 in an axially displaceable manner (via the sliding element 14 and possibly also via the plate 16). The starting position is supported via a form-fitting connection between the camshaft adjuster 3 and the camshaft 5. At the same time, the rotor 6 locks automatically with the stator 4 in the late position via the locking pin 12 of the late-locking device 13.

The second actuator 10 has a fork-shaped plate 16 or fork, which is connected to the ram 11 of the second actuator 10 so that it is mounted in the second actuator 10 such that it cannot rotate. The width of this plate 16 makes it possible to compensate for certain tolerances in finding the starting position. The two arms 17*a*, 17*b* or wings of the plate 16 are slightly bent upwards (as a ramp), which enables the unlocking mechanism (sliding element 14) to be actuated even if it is not in the region of the plate when the second actuator 10 is activated 16, but is then pressed over the ramp on the plate 16 by "screwing in" the camshaft adjuster 3 in front of the plate 16.

The second actuator 10, the sliding element 14 in the camshaft adjuster 3 and the locking pin 12 in the camshaft adjuster 3 each have an integrated return spring 15*a*, 15*b*, 15*c*, which the second actuator 10 can then switch/compress together in series with its magnetic force when activated. After deactivation of the second actuator 10, all three components (armature unit in the magnet of the second actuator 10 with the ram 11, sliding element 14 and locking pin 12) are pressed back into their starting position in order to avoid contact between the second actuator 10 and the camshaft adjuster 3 when the internal combustion engine 20 is rotating.

The logic of the 5/4-way proportional valve is shown in FIGS. 12*a* to 12*d*. Positions 1 (FIG. 12*a*), 2 (FIGS. 12*b*) and 3 (FIG. 12*c*) are comparable to a 4/3-way valve. The central locking pins 19*a*, 19*b* in the camshaft adjuster 3 are constantly supplied with oil pressure via the C-channel 37 in the control valve 9 and are therefore unlocked. Position 4 (FIG. 12*d*) serves to "catch" the camshaft adjuster 3 in the center using a ratchet function by switching the C-channel 37 to tank and thus allowing the central locking pins 19*a*, 19*b* to be locked. Since it cannot be predicted exactly at this point in time whether there is already oil pressure in the camshaft adjuster 3 or not, the logic of the control valve 9 in position 4 is to be understood as supporting the ratchet function if residual oil still remains or already existing oil pressure from the pump is present. The B chamber (first sub-chamber 7*a*) is emptied and allows adjustment from late to center.

Figure 13:
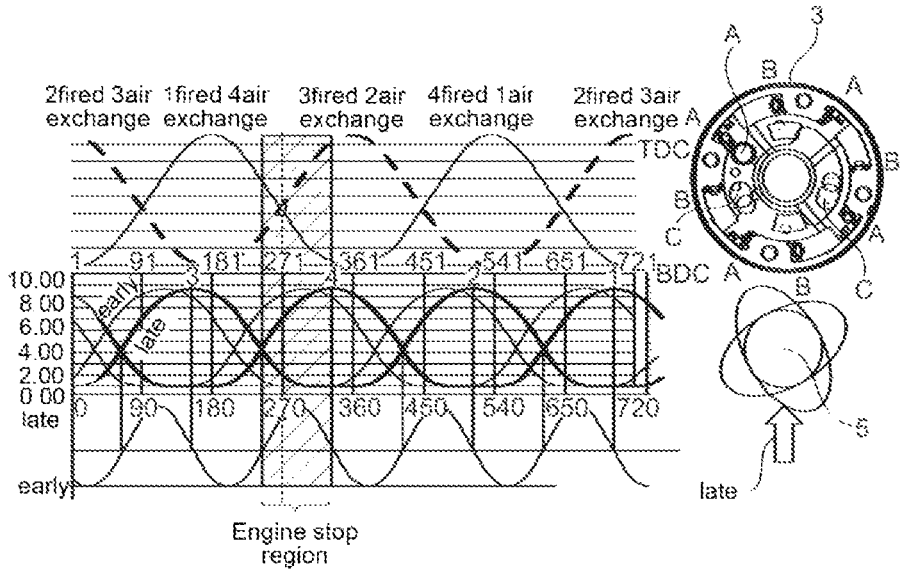
FIGS. 13 and 14 show different diagrams to illustrate an adjustment process of an angular position of a camshaft relative to a crankshaft of the internal combustion engine by rotating the crankshaft forward by means of an electric machine.
Figure 14:
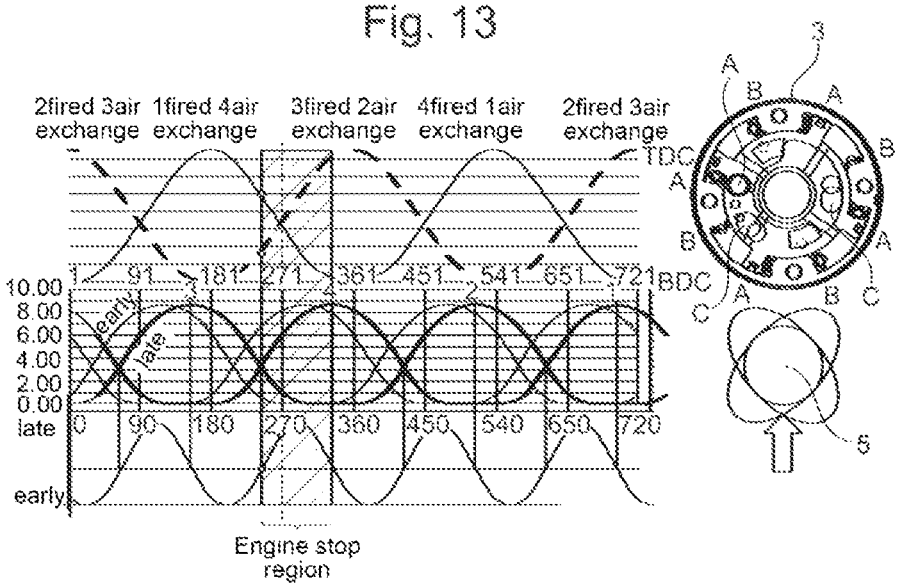
Figure 15:
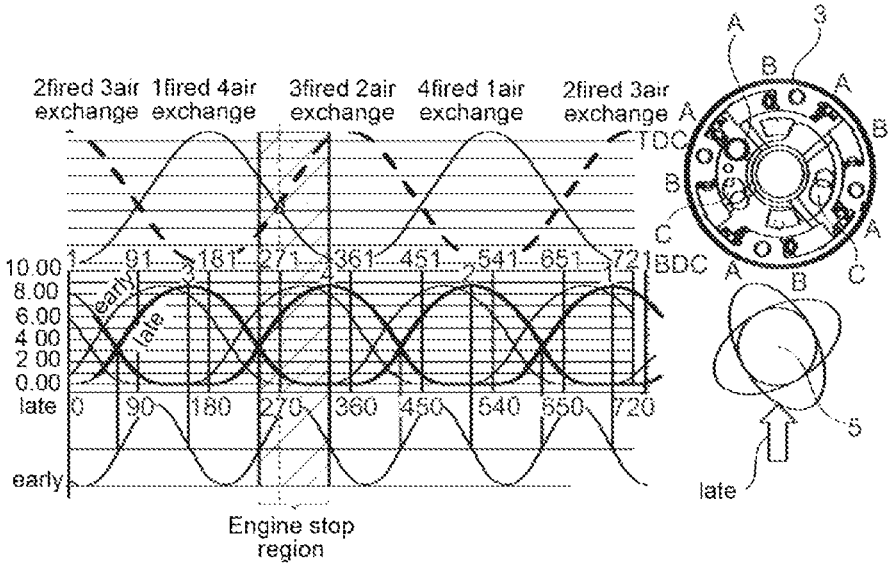
FIGS. 15 and 16 show various diagrams to illustrate the adjustment process of the angular position of the camshaft relative to the crankshaft, similar to FIGS. 13 and 14, wherein the crankshaft now undergoes reverse rotation by the electric machine.
Figure 16:
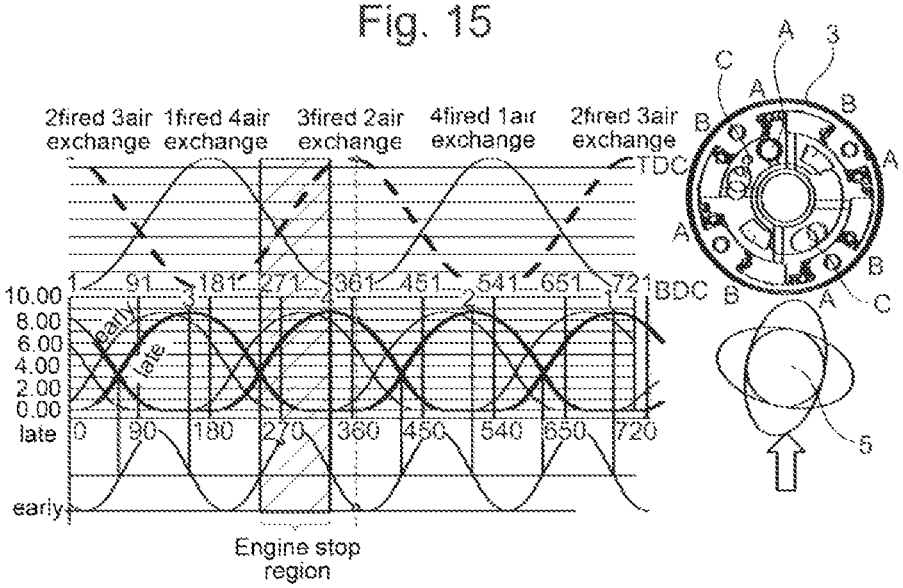

FIGS. 13 to 16 show three different concepts of how the crankshaft 21 can be rotated via the electric machine 23 before start-up so that when the second actuator 10 is activated, a relative movement takes place between the rotor 6 and the stator 4 and the camshaft adjuster 3 can be rotated from its late position to a center position. FIGS. 15 and 16 show the concept of a forward rotation of the crankshaft 21 via the electric machine 23, while FIGS. 13 and 14 show the concept of a backward rotation of the crankshaft 21 via the electric machine 23, wherein the friction torque on the camshaft 5 facilitates safe rotation of the stator 4 to the rotor 6.

LIST OF REFERENCE SYMBOLS

1 Camshaft adjustment system
2 Working chamber
3 Camshaft adjuster
4 Stator
5 Camshaft
6 Rotor
7*a* First sub-chamber
7*b* Second sub-chamber
8 First actuator
9 Control valve
10 Second actuator
11 Ram
12 Locking pin
13 Late-locking device
14 Sliding element
15*a* First return spring
15*b* Second return spring
15*c* Third return spring
16 Plate

17*a* First arm
17*b* Second arm
18 Central locking device
19*a* First central locking pin
19*b* Second central locking pin
20 Internal combustion engine
21 Crankshaft
22 Timing drive
23 Electric machine
24 Camshaft sensor
25 Crankshaft sensor
26 Wheel
27 Armature
28 Control device
29 Receiving hole
30 Cover
31 Plate region
32 Pin extension
33 Web region
34*a* First hole
34*b* Second hole
34*c* Third hole
35*a* First cover segment
35*b* Second cover segment
36 Drive train
37 C-channel
38 Wings
39*a* First trigger wheel
39*b* Second trigger wheel
40 Late stop

The invention claimed is:

1. A camshaft adjustment system, comprising:

a hydraulic camshaft adjuster having at least one working chamber formed between a stator and a rotor, the rotor configured to be rotatable relative to the stator, and at least one of the at least one working chamber is divided into a first sub-chamber and a second sub-chamber, and the first sub-chamber and the second sub-chamber are fluidly connected with a control valve controllable via a first actuator, such that: i) when the first sub-chamber undergoes a volume increase, the rotor is displaced into a late position relative to the stator, and ii) when the second sub-chamber undergoes a volume increase, the rotor is displaced into an early position relative to the stator, and a second actuator actuated independently of the first actuator, the second actuator electronically controlled and having a ram configured to displace a locking pin of a late-locking device of the hydraulic camshaft adjuster so as to release the hydraulic camshaft adjuster from a locked late position when the hydraulic camshaft adjuster is in an operating state.

2. The camshaft adjustment system according to claim 1, wherein the hydraulic camshaft adjuster is configured such that when a hydraulic pressure falls below a minimum hydraulic pressure, the hydraulic camshaft adjuster is automatically rotated into a predetermined starting position relative to the second actuator in which the ram is coupled in an axially displaceable manner to the locking pin.

3. The camshaft adjustment system according to claim 1, wherein the late-locking device is configured such that when a hydraulic pressure of the hydraulic camshaft adjuster falls below a minimum hydraulic pressure, the rotor is displaced into the late position and the locking pin of the late-locking device automatically locks the rotor in a rotationally fixed manner relative to the stator (4).

4. The camshaft adjustment system according to claim 1, wherein the ram is indirectly axially coupled to the locking pin via an axially displaceable sliding element slidably accommodated in the stator.

5. The camshaft adjustment system according to claim 4, wherein at least one of the ram or the axially displaceable sliding element is preloaded by a return spring to a rest position.

6. The camshaft adjustment system according to claim 4, wherein the ram is coupled to the axially displaceable sliding element via a plate, and two arms of the plate extending to opposite peripheral sides are arranged at a same radial position as the axially displaceable sliding element relative to an axis of rotation of the hydraulic camshaft adjuster.

7. The camshaft adjustment system according to claim 6, wherein the hydraulic camshaft adjuster further comprises a central locking device configured for locking the rotor relative to the stator in at least one center position offset from the late position towards the early position.

8. The camshaft adjustment system according to claim 7, wherein the central locking device forms a multi-stage ratchet.

9. A method for operating a drive train having a camshaft adjustment system according to claim 1, wherein: i) the stator is rotatably coupled to a crankshaft of an internal combustion engine via a timing drive, ii) the rotor is attached to a camshaft of the internal combustion engine, and an electric machine is operatively connected to the crankshaft, wherein the method comprises:

unlocking the late-locking device supporting the rotor in the late position relative to the stator via activating the second actuator, and rotating the crankshaft via the electric machine such that the stator and the rotor of the hydraulic camshaft adjuster are rotated relative to one another towards the early position until a central locking device automatically locks the hydraulic camshaft adjuster in a center position.

10. The method according to claim 9, wherein the electric machine rotates the crankshaft against a main direction of rotation implemented during operation of the internal combustion engine.

11. The camshaft adjustment system according to claim 1, wherein the second actuator is located outside of the hydraulic camshaft adjuster.

* * * * *